US007810350B2

(12) United States Patent
Shelton

(10) Patent No.: US 7,810,350 B2
(45) Date of Patent: Oct. 12, 2010

(54) BEVERAGE DISPENSING COOLER

(76) Inventor: Andrew C. Shelton, 4475 Sylvan Rd., Indianapolis, IN (US) 46228

( * ) Notice: Subject to any disclaimer, the term of this patent is extended or adjusted under 35 U.S.C. 154(b) by 513 days.

(21) Appl. No.: 11/726,487

(22) Filed: Mar. 22, 2007

(65) Prior Publication Data

US 2008/0229778 A1 Sep. 25, 2008

(51) Int. Cl.
*F25D 3/08* (2006.01)

(52) U.S. Cl. ..... 62/457.5; 62/371

(58) Field of Classification Search ..... 62/457.5, 62/371, 372, 530, 378; 206/427, 139; 221/303, 221/309, 150 R, 103, 107
See application file for complete search history.

(56) References Cited

U.S. PATENT DOCUMENTS

| | | | | | |
|---|---|---|---|---|---|
| 1,027,660 | A | * | 5/1912 | Larrance | 217/129 |
| 1,606,679 | A | * | 11/1926 | Wagner | 221/97 |
| 1,898,056 | A | * | 2/1933 | Johnson | 229/122.1 |
| 2,266,025 | A | * | 12/1941 | Grau | 221/152 |
| 2,274,065 | A | * | 2/1942 | Hull et al | 221/150 R |
| 2,304,484 | A | * | 12/1942 | Smith | 221/124 |
| 2,432,749 | A | * | 12/1947 | Glassford | 34/65 |
| 2,558,181 | A | * | 6/1951 | Kassel | 62/166 |
| 2,704,627 | A | | 3/1955 | Brulin et al. | |
| 2,779,169 | A | * | 1/1957 | Sharpe et al. | 62/378 |
| 2,913,142 | A | * | 11/1959 | Salisbury | 221/105 |
| 3,085,712 | A | * | 4/1963 | Skumawitz | 221/150 R |
| 3,110,417 | A | * | 11/1963 | Wingate et al. | 221/111 |
| 3,263,806 | A | | 8/1966 | Ring | |
| 3,332,594 | A | * | 7/1967 | De Capua | 221/185 |
| 3,858,757 | A | * | 1/1975 | Langdon, Jr. | 221/92 |
| 4,018,271 | A | | 4/1977 | Jones et al. | |
| 4,368,625 | A | * | 1/1983 | Platt | 62/378 |
| 4,485,937 | A | * | 12/1984 | Adams | 221/129 |
| 4,583,659 | A | * | 4/1986 | Carter | 221/279 |
| 4,673,117 | A | | 6/1987 | Calton | |
| 4,676,074 | A | * | 6/1987 | Morgan et al. | 62/277 |
| 4,721,237 | A | | 1/1988 | Leslie | |
| 4,823,983 | A | * | 4/1989 | Groover et al. | 221/92 |
| 4,872,589 | A | * | 10/1989 | Englehart et al. | 229/117.13 |
| 4,997,106 | A | * | 3/1991 | Rockola | 221/95 |
| 5,086,948 | A | * | 2/1992 | Slusarz | 221/185 |
| 5,095,718 | A | | 3/1992 | Ormond et al. | |
| 5,247,798 | A | * | 9/1993 | Collard, Jr. | 62/3.62 |
| 5,356,033 | A | * | 10/1994 | Delaney | 221/194 |
| 5,611,457 | A | | 3/1997 | Ash, Jr. | |
| 5,826,746 | A | * | 10/1998 | Ash, Jr. | 221/185 |
| 5,848,726 | A | * | 12/1998 | Yajima et al. | 221/150 HC |
| 5,921,435 | A | | 7/1999 | Billet | |
| 6,189,731 | B1 | * | 2/2001 | Schmitt | 221/103 |
| 6,234,345 | B1 | * | 5/2001 | Minh et al. | 221/124 |
| 7,024,882 | B2 | * | 4/2006 | Carmichael et al. | 62/457.5 |
| 7,344,028 | B2 | * | 3/2008 | Hanson | 206/545 |

U.S. PATENT DOCUMENTS

| | | | | | |
|---|---|---|---|---|---|
| 7,418,311 | B1 | * | 8/2008 | Lagassey et al. | 700/236 |
| 2003/0218023 | A1 | * | 11/2003 | Zangari et al. | 221/150 R |
| 2005/0056047 | A1 | * | 3/2005 | Carmichael et al. | 62/457.5 |
| 2006/0112723 | A1 | | 6/2006 | Shelton | |

* cited by examiner

OTHER PUBLICATIONS

Rocket Man™, Mobile Drink Systems, Can Pak, web page revised Feb. 20, 2001, 2 pgs.

*Primary Examiner*—Frantz F Jules
*Assistant Examiner*—Alexis K Cox
(74) *Attorney, Agent, or Firm*—Baker & Daniels LLP

(57) ABSTRACT

A wearable cooler device for the transport of consumables having multiple access ports near the bottom thereof and containing pathways that direct the consumables to areas proximate the access ports, thereby allowing easy removal while preventing the unintended egress of the consumables from the wearable cooler.

17 Claims, 7 Drawing Sheets

BEVERAGE DISPENSING COOLER

FIELD

The present disclosure relates generally to portable dispensers for substantially cylindrical containers and more particularly to backpacks for dispensing beverages.

BACKGROUND AND SUMMARY

Many of the previously known insulated packs for dispensing beverages have been designed primarily for use by vendors and are not sufficiently compact for personal use. Previously known compact packs sized for personal use have a capacity for relatively few canned or bottled beverages or are designed only for top loading items such as baby food. Further, prior packs that include two or more vertical stacks of canned beverages leading to a single dispensing path have no mechanism for avoiding a gridlock or jamming of the cans within the pack.

SUMMARY OF THE INVENTION

In a first embodiment of the present disclosure, a portable cooler is provided. The cooler including a housing defining an interior volume and having at least one access point proximate a lower end of the housing; and a removable guide sized and shaped to be removably positioned within the interior volume, wherein the guide directs containers within the interior volume to a location proximate the at least one access point of the housing, the guide retaining containers within the housing when the at least one access point is open.

According to another embodiment of the present disclosure, a cooler element is provided. The cooler element includes a guide sized and shaped to be removably positioned within an interior volume of a cooler having two access points located on opposite sides of the cooler and proximate a lower end of the cooler, wherein the guide directs containers within the interior volume to a location proximate one of the two access points.

According to yet another embodiment of the present disclosure, a method of using a cooler is provided. The method including the steps of providing a housing; providing a removable guide sized and shaped to be received within the housing; and providing a removable liner sized and shaped to be selectively coupled to the housing.

DETAILED DESCRIPTION

Figure 1:
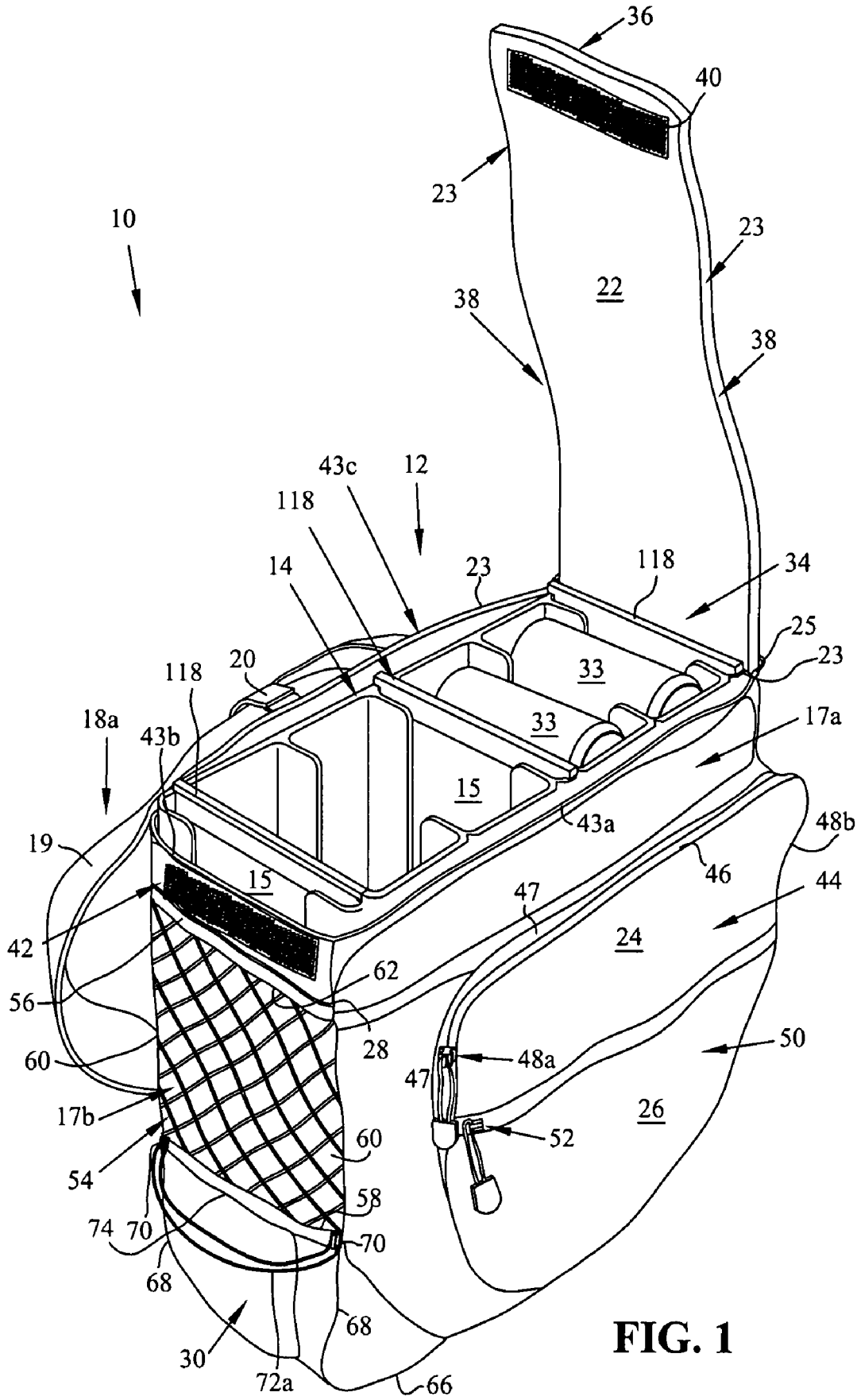
FIG. 1 is a perspective view of a pack according to the present disclosure partially loaded with beverages.

As shown in FIG. 1, an embodiment of container 10 is provided in the form of a backpack for the retention, conveyance, and thermal control of a plurality of beverages or other perishables. Container 10 includes cover 12, framework 14, and thermal packs 15. Optionally, liner 16 may be employed in place of framework 14.

Figure 2:
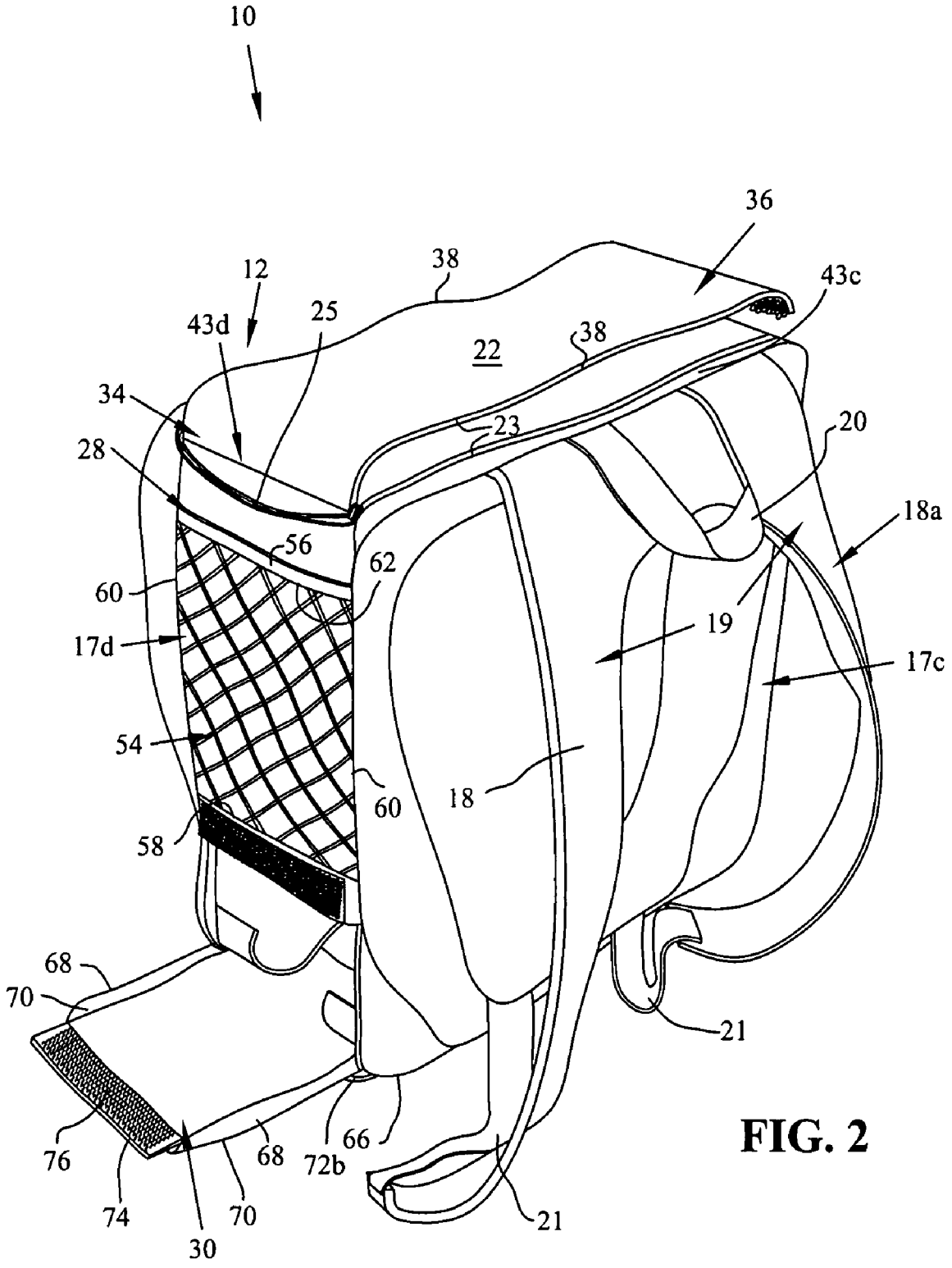
FIG. 2 is a perspective view of a cover of the pack of FIG. 1.
Figure 3:
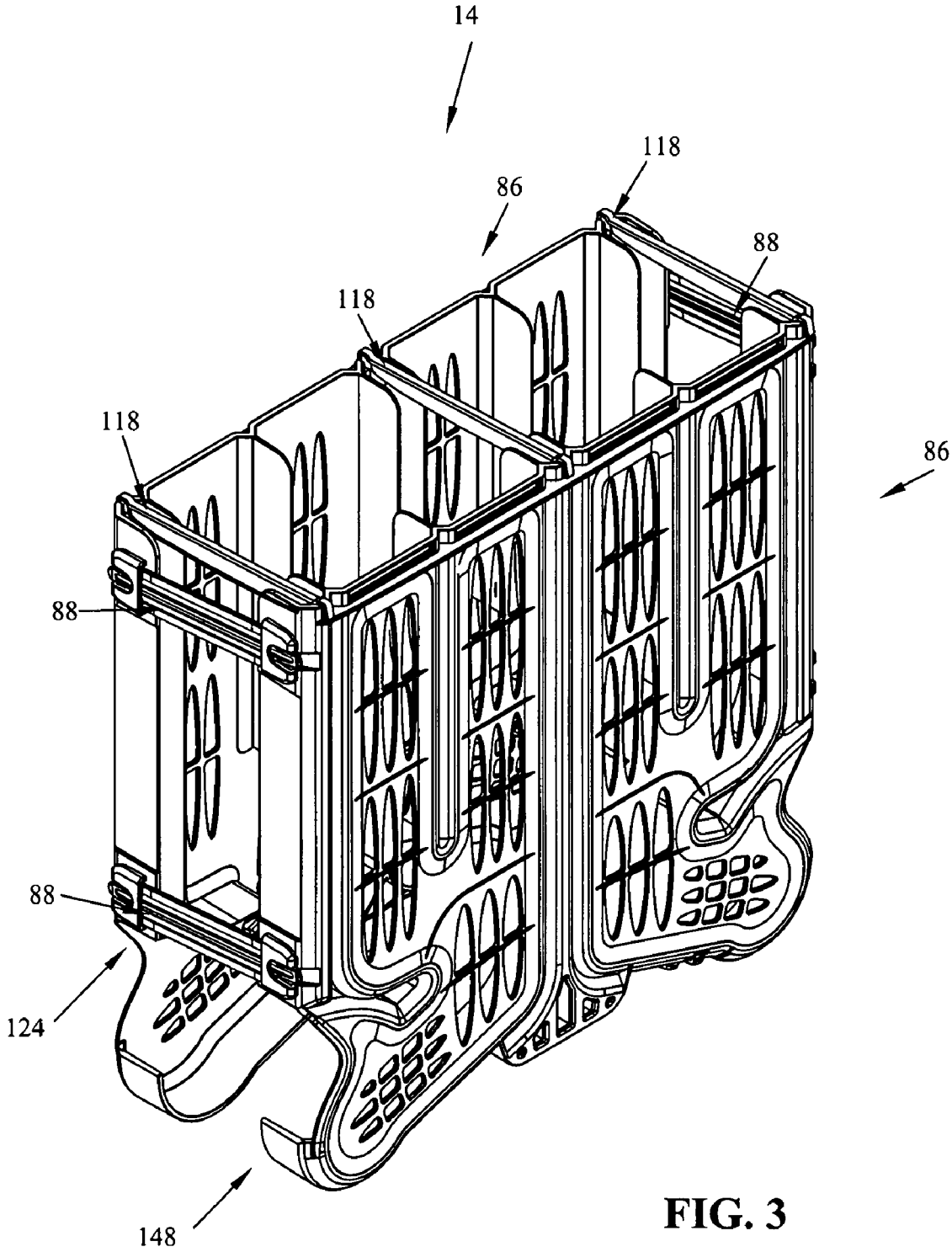
FIG. 3 is a perspective view of an assembled framework of the pack of FIG. 1.

FIGS. 1 and 2 show an embodiment of cover 12 of container 10 suitable for receiving framework 14 or liner 16. Cover 12 includes insulated walls 17*a-d,* shoulder straps 18, 18*a*, hanging strap 20, top cover 22, front pockets 24, 26, side pockets 28, dispensing flaps 30, and liner retainers (not shown).

Shoulder straps 18, 18*a* are provided for carrying container 10 as a backpack. Shoulder straps 18, 18*a* are adjustable and include padded upper portions 19 and straps 21. Padded upper portions 19 are sewn or otherwise affixed to upper edge 43*c* of back wall 17*c*. Straps 21 are sewn or otherwise affixed to lower portions near the interface of back wall 17*c* and respective side walls 17*b,d.* Hanging strap 20 is provided by which container 10 may be hung such that the weight of container 10 is approximately evenly distributed on each side thereof (assuming substantially even payload distribution). Top cover 22 includes fixed end 34, access end 36, and a pair of sides 38 extending between fixed end 34 and access end 36. Fixed end 34 is sewn to insulated wall 17*d*. Access end 36 includes a strip of hook and loop fastener 40 that corresponds to a similarly sized strip of hook and loop fastener 42 coupled proximate upper edge 43*b* of insulated wall 17*b*. Each of sides 38 have one half of zipper 23 coupled thereto that mate with halves of zippers 23 on upper edges 43*a,c* of respective insulated walls 17*a,c*. Accordingly, top cover 22 can be lifted by access end 36 to open container 10 or top cover 22 can be secured by hook and loop fastener 42 and zippers 23 for closure. Strap 25 extends between zippers 23 such that pulling on strap 25 pulls both zippers 23.

Front pockets 24, 26 are positioned on the exterior of front insulated wall 17*a*. Pocket 24 includes outer wall 44 that is insulated. Outer wall 44 includes an area where signage may be stitched therein or otherwise affixed. Upper edge 46 and portions of side walls 48*a,b* have one half of zipper 47 coupled thereto that mate with a half of a zipper 47 on front insulated wall 17*a* to selectively close pocket 24. The interior of front pocket 24 forms a waterproof pouch. Pocket 26 is positioned on the exterior of outer wall 44. Pocket 26 is not waterproof and includes outer wall 50. Pocket 26 is selectively opened and closed via zipper 52.

Side pockets 28 each include mesh portions 54 and elastic portions 56. Mesh portions 54 are sewn to respective side walls 17*b,d* at lower ends 58 and sides 60. Upper ends 62 of mesh portions 54 are coupled to elastic portions 56. Elastic portions 56 expand when under load allowing mesh portions 54 to extend outward so that side pockets 28 may receive and retain items therein.

Dispensing flaps 30 are provided at the lower ends of side walls 17*b,d* and provide a portion of bottom 66 of cover 12. Dispensing flaps 30 are formed from an insulated wall. Dispensing flaps 30 are sewn or otherwise fixed to bottom 66. Sides 68 of dispensing flaps 30 have one half of zippers 70 thereon, with complementary sides of zippers 70 coupled to respective walls 17*a,c*. Strap 72*a,b* extends between zippers 70 such that pulling on strap 72*a,b* pulls both zippers 70 on respective flap 30. Inner side of upper ends 74 of flaps 30 include a strip of hook and loop fastener 76 thereon. Complementary strips of hook and loop fastener 76 are mounted on walls 17*b,d*. Accordingly, flaps 30 can be pulled by upper ends 74 after zippers 70 are pulled down to open flaps 30 or flaps 30 can be secured by hook and loop fasteners 76 and zippers 70 for closure.

Liner retainers (not shown) are strips of hook and loop fastener coupled to the interior of walls 17*a-d*. Liner retainers (not shown) are sized and positioned to couple to complementary hook and loop strips 78 on liner 16. Liner 16 is a waterproof pouch having dimensions substantially similar to the interior dimensions of container 10. Liner 16 is formed from a single sheet of waterproof material 82 that is sonically welded or otherwise coupled to form a watertight pouch having open upper edge 84. Hook and loop strips 78 are affixed to surround the outside of open upper edge 84.

Framework 14, as shown in FIGS. 3-6, includes two container guides 86 and six (6) spacing connectors 88. Container guides 86 and connectors 88 can be made from any material that is strong enough to hold many, such as twenty, typical filled beverage containers without significantly bending or breaking and is sufficiently light weight so as not to add a great weight when worn as a part of a backpack. Such suitable materials include aluminum or molded plastic such as polycarbonate, polypropylene, high density polyethylene or polystyrene. As shown, container guides 86 and connectors 88 are formed from injection molded plastic.

Figure 4:
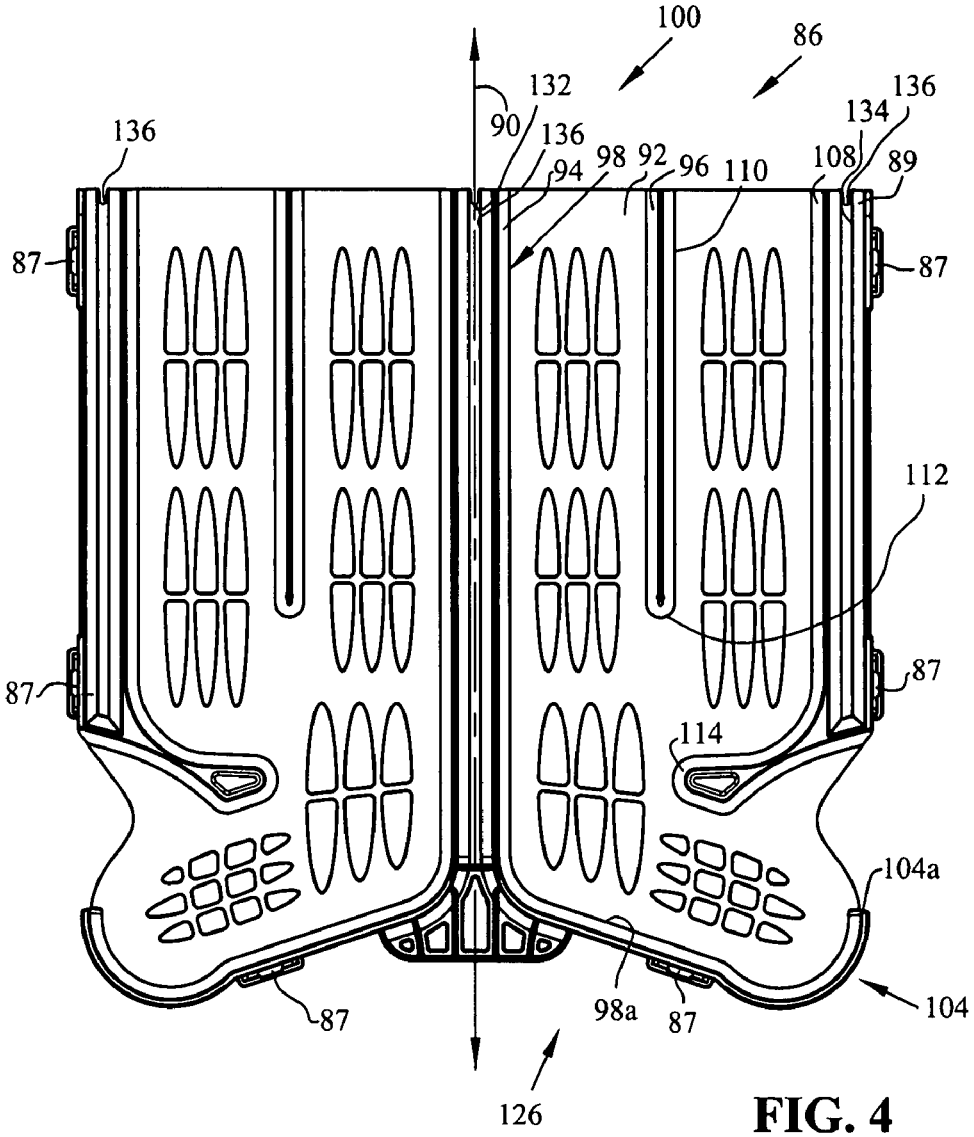
FIG. 4 is a front view of a framework piece used to construct the framework unit of FIG. 4.

FIG. 4 shows container guide 86 that can be either a front or back framework component. Front and back container guides 86 are identical and can be produced in the same injection mold. Front and back container guides 86 are also symmetrical about central axis 90. Accordingly, only one side will be discussed with the understanding that identical structure is present on the opposite side.

The front and back container guides 86 each include substantially flat back wall 92. Ridges 94 and 96 extend substantially perpendicularly from back wall 92 to form first pathway 98, which extends downwardly from container receiving upper end 100 and ends at first shaped rigid member 104. Rigid member 104 is shaped to block the movement of containers in the absence of manipulation by an operator.

Ridges 96 and 108 form second pathway 110 that begins at container receiving upper end 100 and extends to merging location 112 at which second pathway 110 merges with first pathway 98. Ridge 108 ends at second rigid shaped member 114. Second rigid shaped member 114 is shaped and positioned so as to allow containers in second pathway 110 to merge into first pathway 98 when containers are in first pathway 98 only by moving laterally so that containers in second pathway 110 merge into first pathway 98 only when a highest container 33 in first pathway 98 is below merging location 112.

It should be appreciated that ridges 94 of the respective sides define a vertical gap 132 therebetween. Similarly, ridge 108 and side ridge 89 define a vertical gap 134 of a width similar to gap 132. Notches 136 are defined in back wall 92 near upper end 100 of each gap 132, 134. Gaps 132, 134 are sized to receive thermal packs 15 therein.

Each container guide 86 includes six spacing connector voids 87 therein. Spacing connector voids 87 are located on each side ridge 89 with one near upper end 100 and one near dispensing point 124, and on bottom 126. Spacing connector voids 87 are sized to receive spacing connectors 88 therein. Container guides 86 further include shoulders 128 (see FIG. 6) proximate connector voids 87 that engage lock shoulders 130 of spacing connectors 88 thereon.

Figure 5:
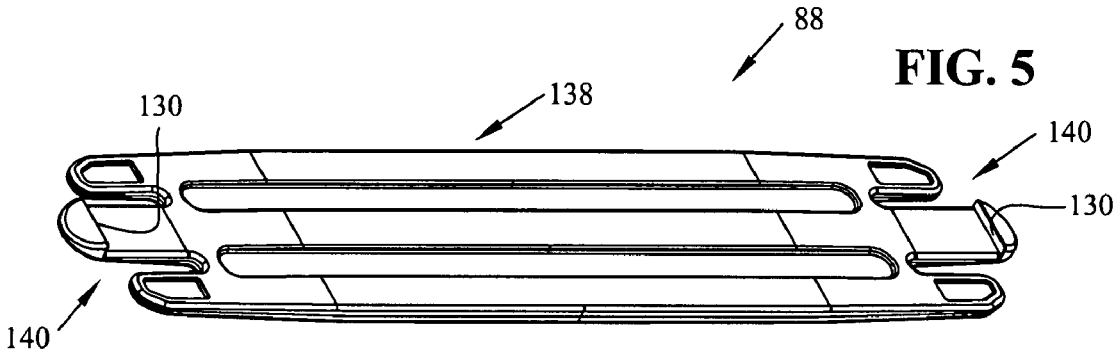
FIG. 5 is a perspective view of connectors of the framework unit of FIG. 4.

As shown in FIG. 5, assembled container guides 86 are spaced apart by spacing connectors 88 that connect to form framework 14 for holding and dispensing cylindrical containers, such as cans 33 or bottles containing beverages. Spacing connectors 88 include body 138 and tabs 140. Body 138 is substantially flat and of any useful length, depending on the typical height of beverage cans 33 or bottles expected to be used in the resulting container 10. Tabs 140 include lock shoulders 130 sized and shaped to engage shoulders 128 of container guides 86. Alternatively, container guides 86 and spacing connectors 88 may be connected by any of a variety of well known fastening mechanisms and techniques, including riveting and ultrasonic welding. It should also be appreciated that the entire framework 14 could be injection molded as one piece.

Spacing connectors 88 hold container guides 86 sufficiently far apart to enable free movement of beverage containers down pathways 98, 110 while at the same time maintaining container guides 86 sufficiently close that movement of beverage containers down pathways 98, 110 is controlled by ridges 94, 96, 108. Spacing connectors 88 are between four and six inches in length. Each ridge 94, 96, 108 within each set of ridges is sufficiently far apart from the other to accommodate the diameter of a beverage can or bottle.

Figure 7:
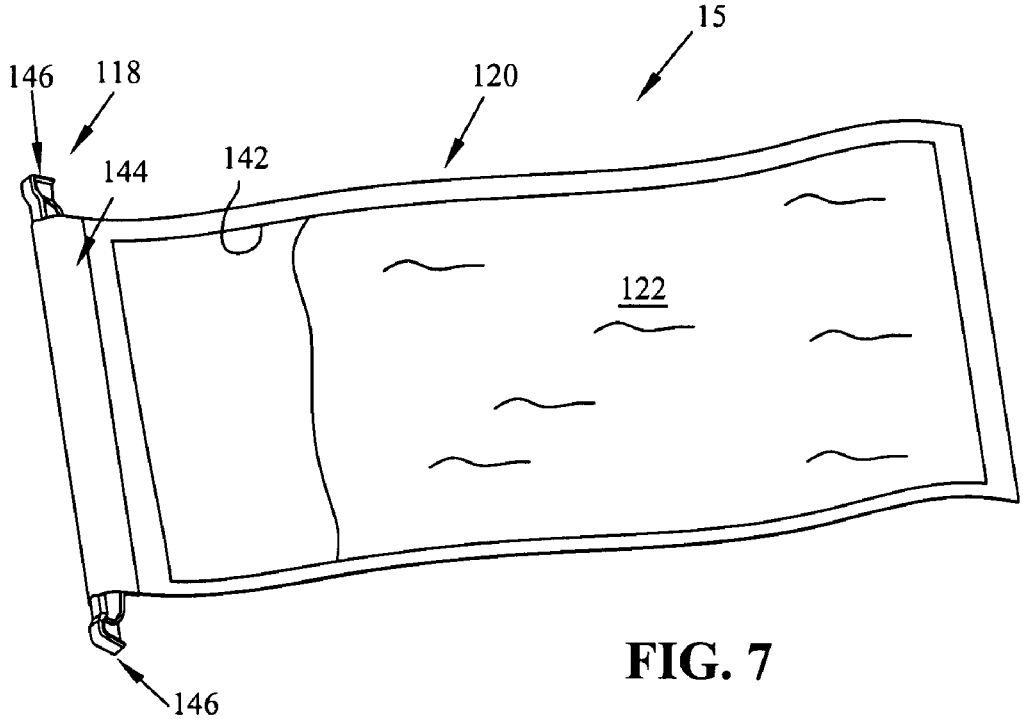
FIG. 7 is a perspective view of thermal packs used with the pack of FIG. 1.
Figure 9:
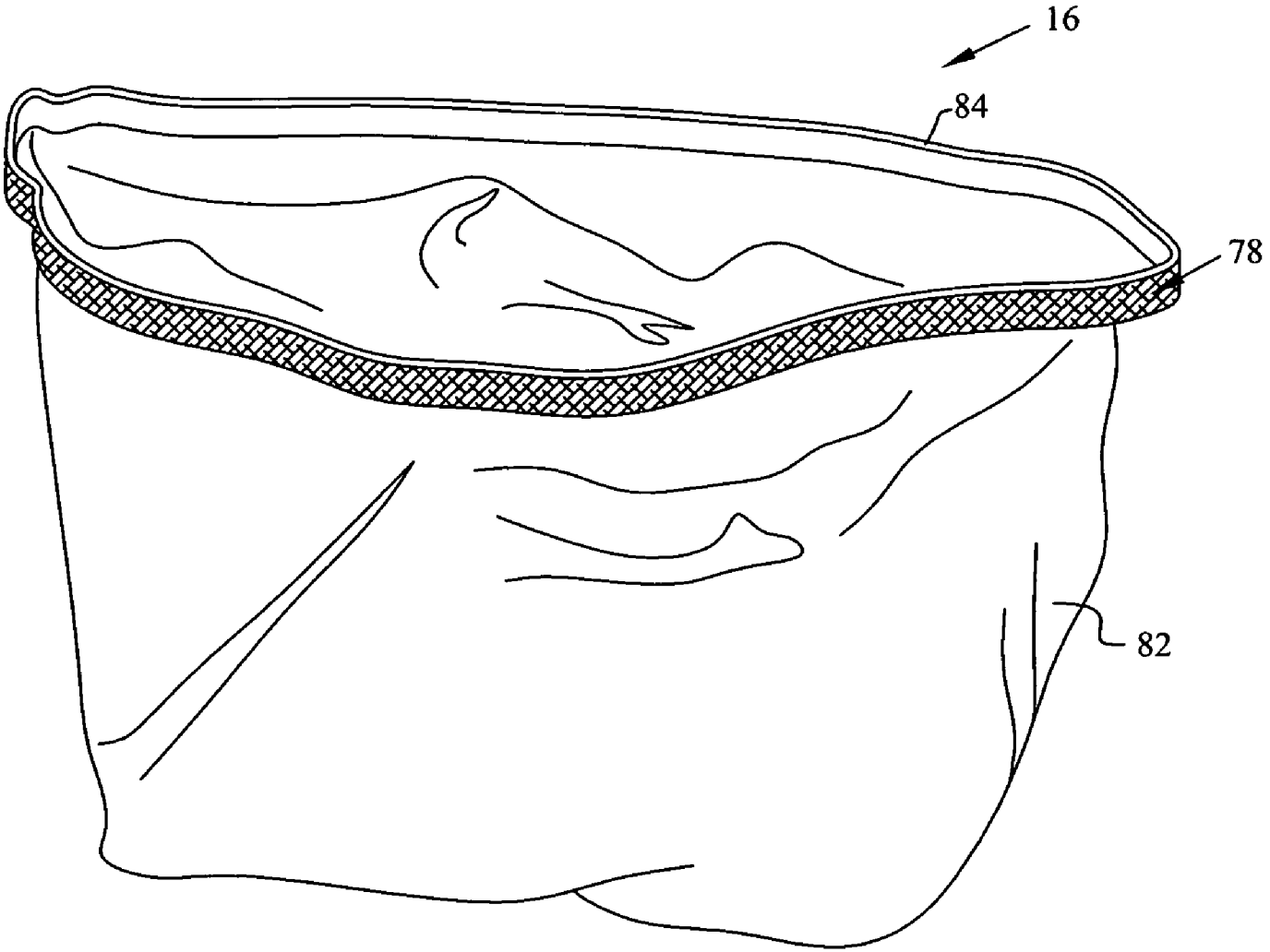
FIG. 9 is a perspective view of a liner for use with the cover of FIG. 2.

Thermal packs 15, as shown in FIG. 7, include hangers 118, pouches 120, and thermal gel 122. Hangers 118 are of a length to span between opposing back walls 92 and are sized to snugly fit in notches 136. Each pouch 120 is formed from flexible plastic and includes gel compartment 142 and hanger receiving portion 144. Gel compartment 142 is sealed to minimize escape of thermal gel 122 contained therein. Hanger receiving portion 144 is a doubled over portion that provides an opening through which hanger 118 may extend. Hanger receiving portion 144 and thermal packs 15 in general is of a width less than hangers 118 and framework 14. Ends 146 of hangers 118 are sized and shaped to engage notches 136. When hangers 118 are within hanger receiving portion 144 and ends 146 engage notches 136, thermal packs 15 hang within gaps 132, 134. This placement allows thermal packs 15 to be proximate any beverages stored in framework 14. Thermal packs 15 are placed in a freezer or otherwise extensively cooled prior to insertion into gaps 132, 134. Accordingly, thermal packs 15 cool stored beverages within framework 14.

Beverage containers are removed from the assembled framework 14, after opening dispensing flaps 30, by an operator by moving the selected container 33 upwardly over edge 104*a* of the first shaped rigid member 104.

Figure 6:
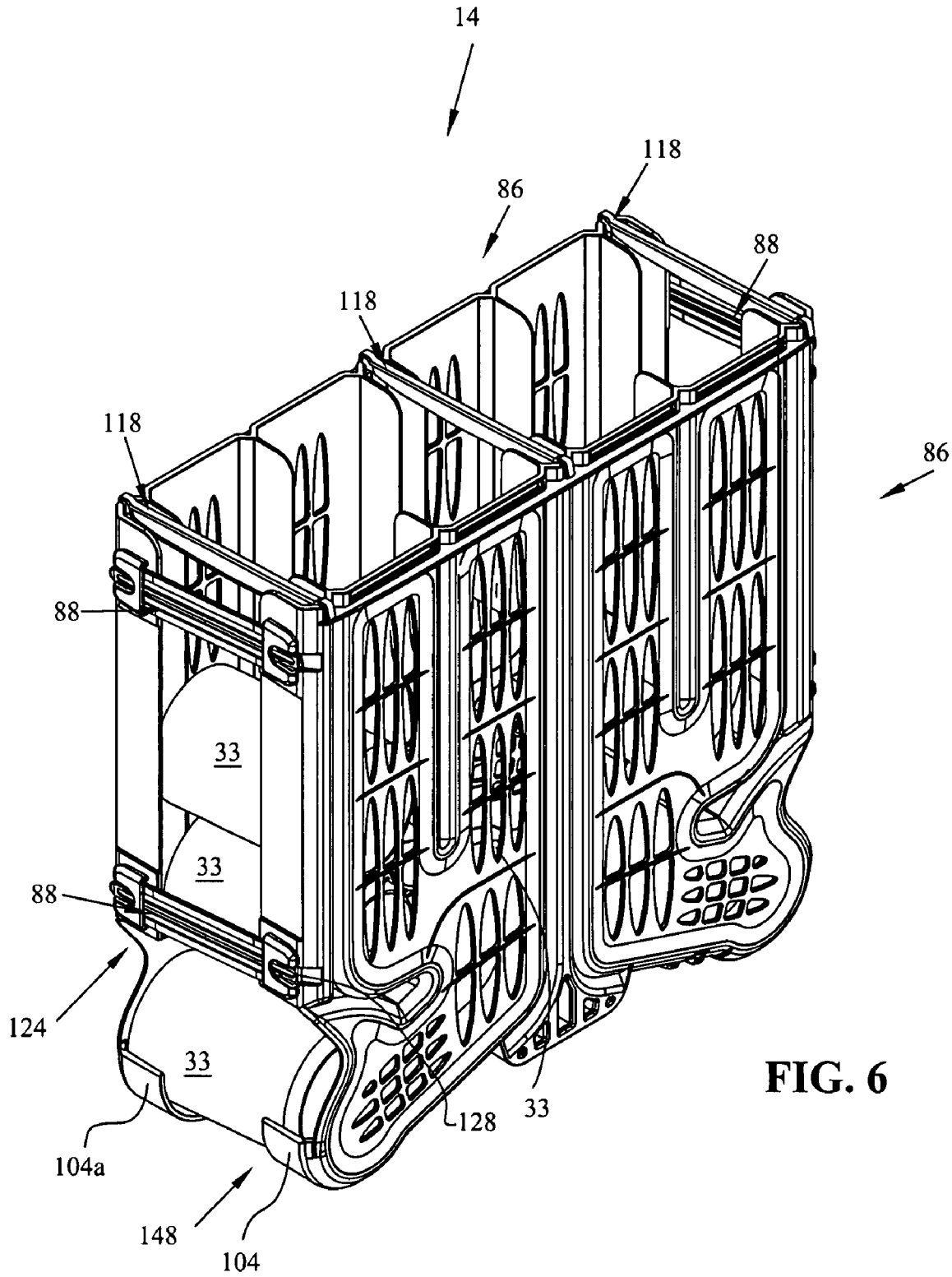
FIG. 6 is a perspective view of the framework of FIG. 3 with a plurality of beverage cans ready for extraction therefrom.
Figure 8:
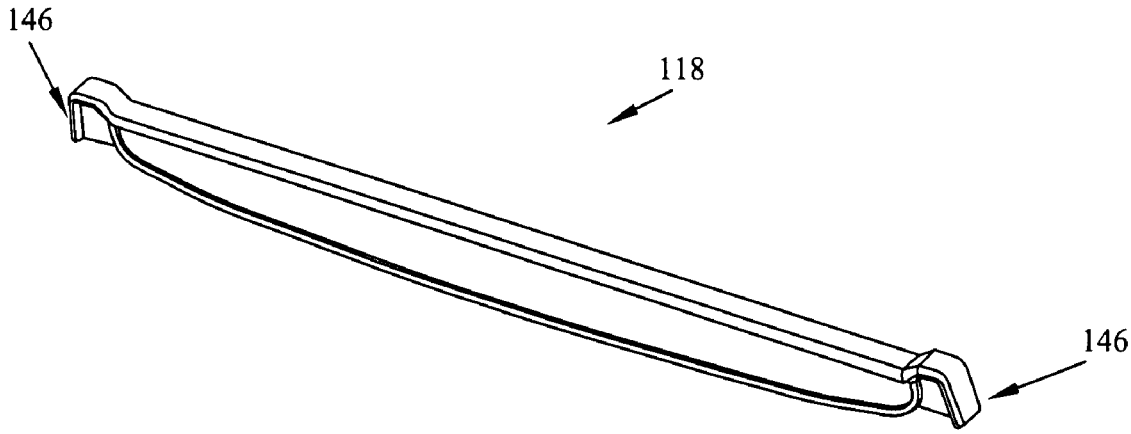
FIG. 8 is a perspective view of a hanger of the thermal packs of FIG. 7.

FIG. 6 shows assembled framework 14 holding beverage cans 33 in first pathway 98, which descends from container receiving upper end 100 of framework 14 and curves into a downward sloping path 98*a*, ending at first rigid shaped member 104. Member 104 is formed by the upturned terminal portions of ridges 94 on both front and back container guides 86 and is shaped and positioned to stop progress of a beverage container, such as can 33, either when alone in framework 14 or when it is under pressure from the weight of additional cans 33 above it in first pathway 98-98*a*. The upturned and centrally opened shape of member 104 also allows easy removal of cans 33 from framework 14 by an upward pressure on can 33 in the area 148 between the upturned terminal portions of the ridges that form member 104.

A second line of beverage cans 33 is shown in FIG. 6 descending second pathway 110 defined by ridges 96, 108 on both the front and back container guides 86. Ridge 108 ends in second rigid shaped member 114 at location 112 where pathway 110 merges with pathway 98-98*a*.

Member 114 is positioned to hold cylindrical containers 33 so that they will be blocked from feeding into pathway 98-98*a* when a container 33 occupies pathway 98-98*a* at location 112, but will feed easily into pathway 98-98*a* when no can or container 33 blocks lateral movement into that pathway 98-98*a*. The lateral movement of containers from pathway 110 into pathway 98-98*a* avoids the downward weight of the containers in pathway 110 against member 104 and facilitates removal of the containers from pathway 98*a*.

FIG. 1 shows pack 10 with top cover 22 opened to show pathways 98, 110 defined by ridges 94, 96, 108. Dispensing flaps 30 are also opened to expose first shaped rigid member 104 and cans 33.

Framework 14 is removable from the interior of container 10. Removal of framework 14 and addition of liner 16 allows container 10 to function more like a traditional cooler. Waterproof liner 16 allows items and ice to be placed therein such that melting ice will not escape through dispensing flaps 30.

The present invention has been illustrated in terms of a backpack for carrying beverages in cans 33 or bottles. It will be understood, however, by those skilled in the art that the device disclosed here for controlling the movement of generally cylindrical shapes in merging, descending pathways to avoid gridlock or jamming of the shapes at the point of merging and to avoid excessive weight on the lowermost such shape will have wide application and is intended to be within the scope of the appended claims. Likewise, a device for holding generally cylindrical shapes in single or multiple descending pathways such that the final such shape can be removed with a relatively small upward pressure will have many applications, each of which are intended to be within the scope of the appended claims.

The invention claimed is:

1. A portable cooler including:

A housing defining an interior volume and having two access points located on opposite sides of the housing proximate a lower end of the housing;

A shoulder strap coupled to the housing;

A removable sized and shaped to be removeably positioned within the interior volume, the guide includes:

A first container pathway,

A second container pathway,

A third container pathway, the third pathway merging with the first container pathway at a first merge point, and A fourth container pathway, the fourth pathway merging with the second pathway at a second merge point, each of the first, second, third, and fourth pathways having a curved portion, the curved portions of the first and fourth pathways curving in a first direction, the curved portions of the second and third pathways curving in a second direction that is opposite the first direction, the guide directing containers within the interior volume to a location proximate one of the two access points of the housing, the guide retaining containers within the housing when the at least two access points are open.

2. The cooler of claim 1, further including a thermal element that is removable from the guide.

3. The cooler of claim 1, wherein the guide includes two substantially identical pieces horizontally coupled together.

4. The cooler of claim 1, further including removable thermal elements located within the interior volume of the housing.

5. The cooler of claim 1, wherein the guide is an injection molded piece.

6. The cooler of claim 1, wherein the guide contacts a front, back, left side, right side, and bottom wall of the housing defining the interior volume.

7. The cooler of claim 1, further including a removable liner sized and shaped to be selectively coupled to the housing.

8. The cooler of claim 1, further including a first access point located at an upper end of the housing; and the two access points proximate a lower end of the housing including a second access point located at a lower end of the housing and a third access point located at the lower end of the housing; the second and third access points being located on opposite sides of the housing, the first, second, and third access points all being sized and shaped to allow a container to pass therethrough.

9. A portable cooler including:

A housing defining an interior volume and having at least two access points located on opposite sides of the cooler proximate a lower end of the housing;

A shoulder strap coupled to the housing;

A removable guide sized and shaped to be removeably positioned within the interior volume of the housing, the guide including:

A first container pathway,

A second container pathway,

A third container pathway, the third pathway merging with the first container pathway at a first merge point, and A fourth container pathway, the fourth pathway merging with the second pathway at a second merge point, each of the first, second, third, and fourth pathways having a curved portion, the curved portion of the first and fourth pathways curving in a first direction, the curved portions of the second and third pathways curving in a second direction that is opposite the first direction, the guide directing containers within the interior volume to a location proximate one of the two access points, the guide retaining containers within the housing when either one of the at least two access points is open.

10. The cooler of claim 1, wherein the first, second, third, and forth pathways each have a linear vertical portion that define a vertical travel path for containers held therein, the linear vertical portions being parallel to each other.

11. The cooler of claim 10, wherein each of the first, second, third, and fourth pathways have a curved portion, the curved portions of the third and fourth pathways terminating at the first and second merge points, respectively.

12. The cooler of claim 1, wherein the first and third pathways are mirror images of the second and fourth pathways.

13. The cooler of claim 9, wherein the first, second, third, and fourth pathways are oriented such that a container in the third pathway must pass through the first merge point and into the first pathway to reach one of the at least two access points and such that a container in the fourth pathway must pass through the second merge point and into the second pathway to reach one of the at least two access points.

14. The cooler of claim 9, wherein each of the first, second, third, and fourth pathways have a curved portion, the curved portions of the third and fourth pathways terminating at the first and second merge points, respectively.

15. The cooler of claim 9, wherein the first pathway is a mirror image of the second pathway and the third pathway is a mirror image of the fourth pathway.

16. The cooler of claim 1, wherein the first, second, third, and fourth pathways are oriented such that a container in the third pathway must pass through the first merge point and into the first pathway to reach one of the two access points and such that a container in the fourth pathway must pass through the second merge point and into the second pathway to reach one of the two access points.

17. The cooler of claim 13, wherein the first, second, third, and fourth pathways each have a linear vertical portion that defines a vertical travel path for containers held therein, the linear vertical portions being parallel to each other.

* * * * *

UNITED STATES PATENT AND TRADEMARK OFFICE

CERTIFICATE OF CORRECTION

PATENT NO. : 7,810,350 B2
APPLICATION NO. : 11/726487
DATED : October 12, 2010
INVENTOR(S) : Andrew C. Shelton It is certified that error appears in the above-identified patent and that said Letters Patent is hereby corrected as shown below:

Column 5, in claim 1, line 6, “removable sized” should read --removable guide sized--; and on line 7, after “volume”, insert --wherein--.

Signed and Sealed this
Eighth Day of March, 2011

David J. Kappos

David J. Kappos
*Director of the United States Patent and Trademark Office*